US011629576B2

(12) United States Patent
Morsy et al.

(10) Patent No.: US 11,629,576 B2
(45) Date of Patent: Apr. 18, 2023

(54) MULTI-LATERAL WELL HEEL TO TOE DEVELOPMENT OPTIMIZATION

(71) Applicant: Chevron U.S.A. Inc., San Ramon, CA (US)

(72) Inventors: Samiha Said Elsayed Morsy, Houston, TX (US); Folly Israel Yeke Kouevi, Houston, TX (US)

(73) Assignee: CHEVRON U.S.A. INC., San Ramon, CA (US)

( * ) Notice: Subject to any disclaimer, the term of this patent is extended or adjusted under 35 U.S.C. 154(b) by 70 days.

(21) Appl. No.: 17/161,921

(22) Filed: Jan. 29, 2021

(65) Prior Publication Data

US 2021/0246763 A1 Aug. 12, 2021

Related U.S. Application Data

(60) Provisional application No. 62/972,402, filed on Feb. 10, 2020.

(51) Int. Cl.
*E21B 41/00* (2006.01)
*E21B 43/26* (2006.01)
*E21B 7/04* (2006.01)

(52) U.S. Cl.
CPC ..... *E21B 41/0035* (2013.01); *E21B 7/046* (2013.01); *E21B 43/26* (2013.01)

(58) Field of Classification Search
CPC ..... E21B 41/0035; E21B 7/046; E21B 43/26
See application file for complete search history.

(56) References Cited

U.S. PATENT DOCUMENTS

| | | | | |
|---|---|---|---|---|
| 5,273,111 | A | 12/1993 | Brannan et al. | |
| 6,729,394 | B1 | 5/2004 | Hassan et al. | |
| 9,394,774 | B2 | 7/2016 | Soliman et al. | |
| 10,087,736 | B1 * | 10/2018 | Al-Mulhem | E21B 43/267 |
| 10,087,737 | B2 | 10/2018 | Bahorich | |
| 2011/0203792 | A1 | 8/2011 | Looney et al. | |
| 2012/0285700 | A1 * | 11/2012 | Scott | E21B 43/2406 166/57 |
| 2013/0146284 | A1 | 6/2013 | Ayasse | |
| 2013/0333885 | A1 | 12/2013 | Carrizales et al. | |
| 2017/0051598 | A1 | 2/2017 | Ouenes | |
| 2017/0145793 | A1 | 5/2017 | Ouenes | |
| 2017/0284179 | A1 | 10/2017 | Butula et al. | |
| 2017/0321548 | A1 * | 11/2017 | Enkababian | E21B 33/12 |

FOREIGN PATENT DOCUMENTS

| | | | |
|---|---|---|---|
| CN | 1888382 | A | 1/2007 |
| CN | 106481327 | A | 3/2017 |
| CN | 208594924 | U | 3/2019 |
| CN | 107558985 | B | 7/2019 |

* cited by examiner

*Primary Examiner* — Catherine Loikith
(74) *Attorney, Agent, or Firm* — King & Spalding LLP

(57) ABSTRACT

Methods of drilling two wells, wherein the two wells are drilled such that the toe of the lateral portion of one well is in proximity to the heel of the lateral portion of the other well. Production from the wells can be improved by a process wherein the formation about the wells is first fractured at the toe of each lateral portion, then fractured along the middle section of each lateral portion, and, lastly, at the heel section of each lateral portion of the wells.

20 Claims, 5 Drawing Sheets

MULTI-LATERAL WELL HEEL TO TOE DEVELOPMENT OPTIMIZATION

RELATED APPLICATIONS

The present application claims priority to U.S. Provisional Patent Application No. 62/972,402 filed Feb. 10, 2020 and titled "Multi-Lateral Well Heel To Toe Development Optimization," the entire content of which is incorporated herein by reference.

TECHNICAL FIELD

The present disclosure relates generally to methods for drilling multilateral wells heel to toe.

BACKGROUND

In hydraulic fracturing operations for hydrocarbon production, uneven fluid distribution and proppant distribution occur frequently among hydraulic fracturing clusters. One of the main causes is that the stress shadow induced by hydraulic fractures created in previous fracturing stages influences the toe cluster the most and the heel cluster the least. Surveillance data shows heelward biased fluid and proppant distribution that results in longer fracture growth in the most heel-ward perforation cluster (SPE 184862-MS & SPE 179149, 184861). This can lead to a non-uniform fluid distribution that favors the heel-side fractures. As toe-side clusters screen out, fluid and proppant are redistributed into heel-side clusters. At the end of the formation stimulation, the cumulative fluid distribution and proppant distribution are heel-biased. The uneven fluid and proppant distribution in the stimulated clusters negatively affects well recovery and production performance (SPE 138427, SPE 144326). In addition, during well production, the pressure drop along the lateral well is not constant and the pressure friction can result in lower production contribution from the toe stages (SPE 164030).

Different completion designs have been tested to attempt to improve the fluid and proppant distribution throughout the well's lateral length. Some trials included changing perforation design, fluid systems, the use of diverters, and proppant size (SPE 184862-MS), while others have added more wells in different areas. Embodiments of the disclosure are directed to a different method of addressing the problem.

SUMMARY

The disclosure is directed to optimizing production of hydrocarbons from lateral wells in well systems. In one example embodiment, the disclosure is directed to a method for drilling that includes drilling a first lateral well extending from a first vertical well and drilling a second lateral well extending from a second lateral well. The first lateral well and second lateral well are positioned about parallel to each other wherein a toe of the second lateral well is closer to a heel of the first lateral well than a toe of the first lateral well. The method further comprises fracturing the toes of the first lateral well and the second lateral well, then fracturing the middle sections of the first lateral well and the second lateral well, and then fracturing the heels of the first lateral well and the second lateral well.

In another example embodiment, the disclosure is directed to a well system comprising a first lateral well extending from a first vertical well, the first lateral well comprising a toe, a middle section, and a heel. The well system further comprises a second lateral well extending from a second vertical well, the second lateral well comprising a toe, a middle section, and a heel. The first lateral well and the second lateral well are about parallel to each other and the toe of the second lateral well is closer to the heel of the first lateral well than a toe of the first lateral well. The well system is formed with the toes of the first lateral well and the second lateral well having been fractured in a first fracturing step, the middle sections of the first lateral well and the second lateral well having been fractured in a second fracturing step, and the heels of the first lateral well and the second lateral well having been fractured in a third fracturing step.

The foregoing embodiments are non-limiting examples and other aspects and embodiments will be described herein. The foregoing summary is provided to introduce various concepts in a simplified form that are further described below in the detailed description. This summary is not intended to identify required or essential features of the claimed subject matter nor is the summary intended to limit the scope of the claimed subject matter.

BRIEF DESCRIPTION OF THE DRAWINGS

The drawings illustrate only example embodiments of methods, systems, and devices for drilling and fracturing wells positioned heel to toe and are therefore not to be considered limiting of the scope of the disclosure. The elements and features shown in the drawings are not necessarily to scale, emphasis instead being placed upon clearly illustrating the principles of the example embodiments. Additionally, certain dimensions or positions may be exaggerated to help visually convey such principles. In the drawings, reference numerals designate like or corresponding, but not necessarily identical, elements.

DETAILED DESCRIPTION OF EXAMPLE EMBODIMENTS

Figure 1:
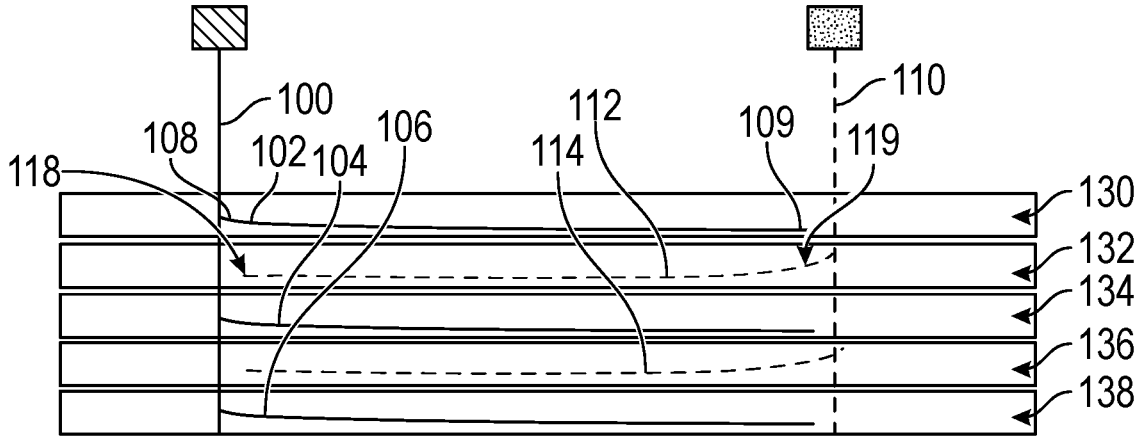
FIG. 1 is a side illustration of two multilateral wells having lateral wells which are drilled heel to toe between the two wells. There is one lateral well per zone of the formation.

The example embodiments discussed herein are directed to methods for drilling wells. Specific embodiments include methods in which wells are drilled such that at least two wells are aligned heel to toe, thus, leading to increased production of the area around the toes of both wells.

Drilling a multilateral well in a formation can be a more cost-effective and efficient approach than drilling multiple individual wells to recover a resource such as a hydrocarbon fluid from a formation. One advantage is that multilateral wells can be drilled in different zones at the same time, so wells can perform better as depletion effects are eliminated with a lower cost. In embodiments of the disclosure, multilateral wells are drilled heel to toe at each bench. In embodiments, when wells are drilled heel to toe in the same bench for a given pad, the heel stage of one well is proximate to the toe stage of the other well. In additional embodiments, highly stimulated heel stages of each well will allow the proximate toe stages of the adjacent well to produce via the stimulated heel stage thereby contributing to the production of the pad to maximize the pad recovery factor. That is, the stress shadow around a toe during fracturing is overcome by fracturing the proximate parallel heel at the same time. Three example embodiments are: drilling pads with individual lateral wells in opposite directions in the same bench, drilling pads with individual wells in opposite directions in different benches vertically, and drilling multilateral wells in opposite directions in the same bench (laterally) and/or location (vertically).

As used in this specification and the following claims, the terms "comprise" (as well as forms, derivatives, or variations thereof, such as "comprising" and "comprises") and "include" (as well as forms, derivatives, or variations thereof, such as "including" and "includes") are inclusive (i.e., open-ended) and do not exclude additional elements or steps. For example, the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Accordingly, these terms are intended to not only cover the recited element(s) or step(s), but may also include other elements or steps not expressly recited. Furthermore, as used herein, the use of the terms "a" or "an" when used in conjunction with an element may mean "one," but it is also consistent with the meaning of "one or more," "at least one," and "one or more than one." Therefore, an element preceded by "a" or "an" does not, without more constraints, preclude the existence of additional identical elements.

The use of the term "about" applies to a numeric value that is close to the numeric value stated. This term generally refers to a range of numbers that one of ordinary skill in the art would consider as a reasonable amount of deviation to the recited numeric values (i.e., having the equivalent function or result). For example, this term can be construed as including a deviation of ±10 percent of the given numeric value provided such a deviation does not alter the end function or result of the value. Therefore, a value of about 1% can be construed to be a range from 0.9% to 1.1%.

It is understood that when combinations, subsets, groups, etc. of elements are disclosed (e.g., combinations of components in a composition, or combinations of steps in a method), that while specific reference to each of the various individual and collective combinations and permutations of these elements may not be explicitly disclosed, each is specifically contemplated and described herein. By way of example, if an item is described herein as including a component of type A, a component of type B, a component of type C, or any combination thereof, it is understood that this phrase describes all of the various individual and collective combinations and permutations of these components. For example, in some embodiments, the item described by this phrase could include only a component of type A. In some embodiments, the item described by this phrase could include only a component of type B. In some embodiments, the item described by this phrase could include only a component of type C. In some embodiments, the item described by this phrase could include a component of type A and a component of type B. In some embodiments, the item described by this phrase could include a component of type A and a component of type C. In some embodiments, the item described by this phrase could include a component of type B and a component of type C. In some embodiments, the item described by this phrase could include a component of type A, a component of type B, and a component of type C. In some embodiments, the item described by this phrase could include two or more components of type A (e.g., A1 and A2). In some embodiments, the item described by this phrase could include two or more components of type B (e.g., B1 and B2). In some embodiments, the item described by this phrase could include two or more components of type C (e.g., C1 and C2). In some embodiments, the item described by this phrase could include two or more of a first component (e.g., two or more components of type A (A1 and A2)), optionally one or more of a second component (e.g., optionally one or more components of type B), and optionally one or more of a third component (e.g., optionally one or more components of type C). In some embodiments, the item described by this phrase could include two or more of a first component (e.g., two or more components of type B (B1 and B2)), optionally one or more of a second component (e.g., optionally one or more components of type A), and optionally one or more of a third component (e.g., optionally one or more components of type C). In some embodiments, the item described by this phrase could include two or more of a first component (e.g., two or more components of type C (C1 and C2)), optionally one or more of a second component (e.g., optionally one or more components of type A), and optionally one or more of a third component (e.g., optionally one or more components of type B).

"Hydrocarbon-bearing formation" or simply "formation" refer to the rock matrix in which a wellbore may be drilled. For example, a formation refers to a body of rock that is sufficiently distinctive and continuous such that it can be mapped. It should be appreciated that while the term "formation" generally refers to geologic formations of interest, the term "formation," as used herein, may, in some instances, include any geologic points or volumes of interest (such as a survey area).

"Unconventional formation" is a hydrocarbon-bearing formation that requires intervention in order to recover hydrocarbons from the reservoir at commercial flow rates. For example, an unconventional formation includes reservoirs having an unconventional microstructure, such as having submicron pore size (a rock matrix with an average pore size less than 1 micrometer), in which the unconventional reservoir must be fractured under pressure in order to recover hydrocarbons from the reservoir at sufficient flow rates.

The formation may include faults, fractures (e.g., naturally occurring fractures, fractures created through hydraulic fracturing, etc.), geobodies, overburdens, underburdens, horizons, salts, salt welds, etc. The formation may be onshore, offshore (e.g., shallow water, deep water, etc.), etc. Furthermore, the formation may include hydrocarbons, such as liquid hydrocarbons (also known as oil or petroleum), gas hydrocarbons, a combination of liquid hydrocarbons and gas hydrocarbons, etc. Hydrocarbons produced from a well are referred to herein as producing a fluid.

The formation, the hydrocarbons, or both may also include non-hydrocarbon items, such as pore space, connate water, brine, fluids from enhanced oil recovery, etc. The formation may also be divided up into one or more hydrocarbon zones, and hydrocarbons can be produced from each desired hydrocarbon zone.

The term formation may be used synonymously with the term reservoir. For example, in some embodiments, the reservoir may be, but is not limited to, a shale reservoir, a carbonate reservoir, etc. Indeed, the terms "formation," "reservoir," "hydrocarbon," and the like are not limited to any description or configuration described herein.

"Wellbore" refers to a continuous hole for use in hydrocarbon recovery, including any openhole or uncased portion of the wellbore. For example, a wellbore may be a cylindrical hole drilled into the formation such that the wellbore is surrounded by the formation, including rocks, sands, sediments, etc. A wellbore may be used for injection. A wellbore may be used for production. A wellbore may be used for hydraulic fracturing of the formation. A wellbore even may be used for multiple purposes, such as injection and production. The wellbore may have vertical, inclined, horizontal, or a combination of trajectories. For example, the wellbore may be a vertical wellbore, a horizontal wellbore, a multilateral wellbore, or slanted wellbore. The term wellbore is not limited to any description or configuration described herein. The term wellbore may be used synonymously with the terms borehole or well.

"Injection fluid," as used herein, refers to any fluid which is injected into a reservoir via a well. "Fracturing fluid" is an injection fluid which is injected into the well under pressure in order to cause fracturing within a portion of the reservoir.

"Fracturing" as used herein refers to pumping fluid into a well under high pressure in order to cause a crack or surface of breakage within an unconventional reservoir. Fracturing fluid can include proppant.

The term "zone," as used herein refers to an interval or unit of lateral rock differentiated from surrounding rock on the basis of its content or other features, such as faults or fractures. One zone may be separated from another zone by impermeable rock. A "landing zone" is a specific zone in which a well will be drilled or has already drilled.

The term "heel" as used herein, in relation to a lateral well, refers to the area of the lateral well that is closest to the main vertical well. The term "toe" as used herein, in relation to a lateral well, refers to the area of the lateral well that is farthest away from the main vertical well (i.e. the toe refers to the termination end of the lateral well).

The term "heel to toe" as used herein refers to an arrangement of two or more wells wherein a first well has a first vertical well section and a first lateral well section and a second well has a second vertical well section and a second lateral well section, wherein the first and second lateral well sections are about parallel to each other, and wherein a toe of the second lateral well section is closer to the heel of the first lateral well section than to the toe of the first lateral well section. "Heel to toe" and "toe to heel" can be used interchangeably.

The term "stress shadow" as used herein refers describes the increase of stress in the direct vicinity of a fracture. If a second hydraulic fracture is created parallel to the existing open fracture within the stress shadow, it will have a closure stress greater than the original in-situ stress, requiring a higher fracture initiation pressure.

Unless defined otherwise, all technical and scientific terms used herein have the same meanings as commonly understood by one of skill in the art to which the disclosed invention belongs. Unless otherwise specified, all percentages are in weight percent and the pressure is in atmospheres.

Example embodiments will be described more fully hereinafter, in which example embodiments of systems, apparatuses, and methods of such drilling are described. It should be understood that such systems, apparatuses, and methods may be embodied in many different forms and should not be construed as limited to the example embodiments set forth herein. Rather, these example embodiments are provided so that this disclosure will be thorough and complete, and will fully convey the scope of the claims to those of ordinary skill in the art. Like, but not necessarily the same, elements in the various figures are denoted by like reference numerals for consistency.

One general embodiment of the disclosure is a method for drilling and fracturing an unconventional reservoir comprising drilling at least two wells in opposite directions (i.e. if a first lateral well is drilled north to south, the following lateral well will be drilled south to north with additional adjacent wells continuing to alternate in direction) and fracturing both wells in opposite directions from toe to heel, thus, reducing the stress shadow on half of the lateral length of each well.

FIG. 1 is a side view illustrating two multilateral wells with the lateral wells of each drilled in opposite directions and with the lateral wells in different zones. As illustrated in FIG. 1, the lateral wells are branch wells extending generally horizontally from the main vertical wellbore. The first multilateral well 100 comprises three lateral wells: the first lateral well 102, the third lateral well 104, and the fifth lateral well 106. The second multilateral well 110 comprises two lateral wells: the second lateral well 112 and the fourth lateral well 114. The multilateral wells are drilled through five zones: the first zone 130, the second zone 132, the third zone 134, the fourth zone 136, and the fifth zone 138. The first zone 130, second zone 132, third zone 134, fourth zone 136, and fifth zone 138 are within a formation. The first lateral well 102 is drilled laterally through the first zone 130, the second lateral well 112 is drilled laterally through the second zone 132, the third lateral well 104 is drilled laterally through the third zone 134, fourth lateral well 114 is drilled through the fourth zone 136, and the fifth lateral well 106 is drilled through the fifth zone 138. All the lateral wells are drilled about parallel to one another, and the toes of each lateral well are in proximity to the heels of the opposing lateral wells. For example, the heel 108 of lateral well 102 is closer to the toe 118 of lateral well 112, than the heel 119 of lateral well 112, and vice versa. The lateral wells of each opposing well are drilled towards the opposite well, but within different zones.

In one embodiment, two multilateral wells are drilled such that the heels of the lateral wells of the first multilateral well are proximate to the toes of the lateral wells of the second multilateral well, with each zone having one lateral well in an alternating pattern from one zone to the next zone as shown in FIG. 1. In a specific embodiment, after the wells are drilled, as shown in FIG. 1, similar sections of each lateral well are fractured simultaneously, starting with the toes of each adjoining lateral well and finishing at the heels of each lateral well. For example, the toe 109 of lateral well 102 and the toe 118 of lateral well 112 would be fractured simultaneously. Following the toes and working along the lateral well, each similar middle section of lateral wells 102 and 112 would be fractured simultaneously, ending with heel sections 108 and 119 being fractured simultaneously. In certain example embodiments, all of the lateral wells (102, 104, 106, 112, 114) could have similar sections fractured simultaneously or nearly simultaneously. In another embodiment, lateral wells 102 and 112 could have lateral well sections fractured simultaneously, which are then followed by lateral wells 104, 114 and 106 having similar lateral well sections fractured simultaneously. In embodiments, having at least two parallel but opposing (heel to toe) lateral wells simultaneously fractured from the toe to the heel of each opposing lateral well mitigates the stress shadow resulting in increased production. For example, fracturing toe 118 and proximate heel 108 will allow toe 118 to produce via heel 108 given the proximity of the two lateral well sections. In certain example embodiments, the vertical well portion of the multilateral well can be horizontally shifted, vertically shifted, or horizontally and vertically shifted from the lateral wells of the opposing multilateral well as long as adjacent lateral wells from the different vertical wells are within a sufficient distance in order to decrease the uneven fluid distribution and proppant distribution caused by the stress shadow.

Figure 2:
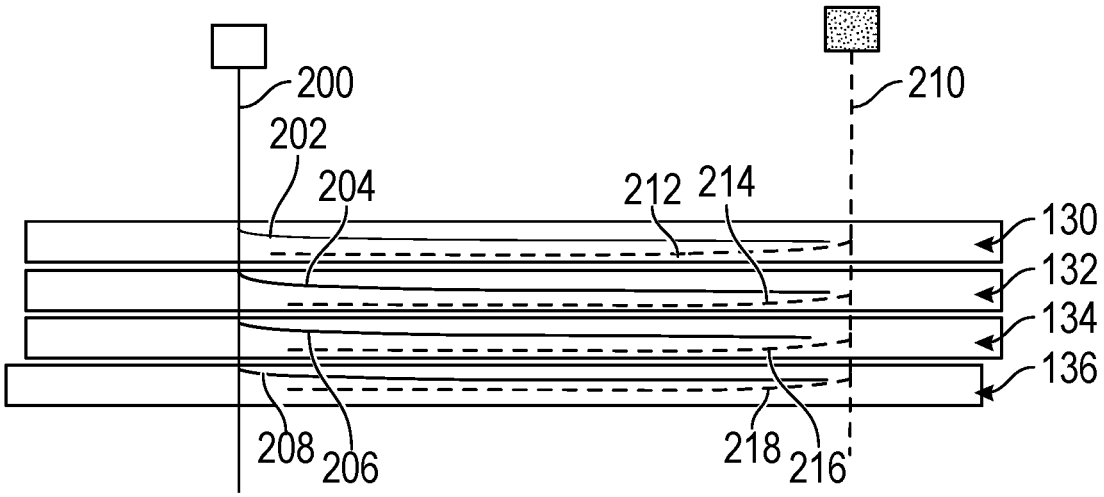
FIG. 2 is a side illustration of two multilateral wells having lateral wells which are drilled heel to toe between the two wells. There are two lateral wells per zone of the formation.

FIG. 2 is a side view illustrating two multilateral wells with the lateral wells of each well drilled towards the opposite well, with each well having a lateral well within the same zone as the opposite well. The arrangement of lateral wells shown in FIG. 2 is known as co-development. The first well 200, comprises four lateral wells: the first lateral well 202, the third lateral well 204, the fifth lateral well 206, and the seventh lateral well 208. The second well 210 also comprises four lateral wells: the second lateral well 212, the fourth lateral well 214, the sixth lateral well 216, and the eighth lateral well 218. The wells are drilled within a formation that is shown to comprise four zones: the first zone 130, the second zone 132, the third zone 134, and the fourth zone 136. As discussed above with respect to FIG. 1, two or more adjoining multilateral wells can have similar lateral well sections fractured simultaneously, each from the toe to the heel, overcoming the stress shadow and resulting in additional production from the formation. In certain example embodiments, the vertical well portion of the multi-lateral well can be horizontally shifted, vertically shifted, or horizontally and vertically shifted from the lateral wells of the opposing multilateral well as long as adjacent lateral wells from the different vertical wells are within a sufficient distance in order to decrease the uneven distribution of fluid and proppant caused by the stress shadow.

It is understood that not all zones within a well need to be laterally drilled. That is, lateral wells are usually drilled within zones that are known or suspected of containing recoverable hydrocarbon materials. While the figures may show that the zones are drilled within sequential zones, multiple zones may be skipped. However, in embodiments of the disclosure when drilling two lateral wells positioned heel to toe, the two wells will be either in adjacent zones or within the same zone. In embodiments, when two adjacent wells that are positioned heel to toe to each other, the lateral wells are within at least 1200 ft. from each other, or within 660-1200 ft of each other.

Figure 3:
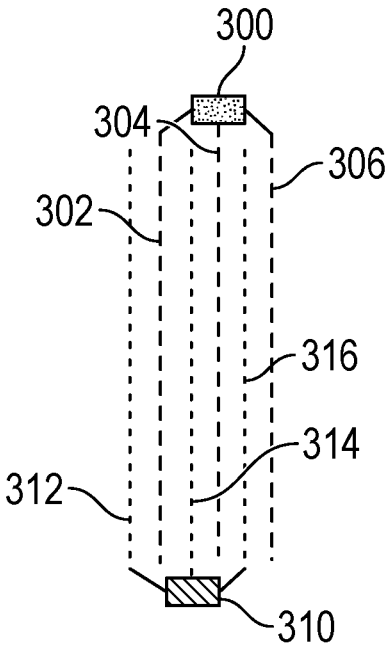
FIG. 3 is an overhead illustration of wells drilled heel to toe between two pads with the first pad having lateral wells drilled in a first zone and the second pad having lateral wells drilled into a second zone.

FIG. 3 is an overhead view illustrating a first pad 300 comprising three lateral wells: a first well 302, a second well 304 and a third well 306; and, a second pad 310 comprising three lateral wells: a fourth well 312, a fifth well 314, and sixth well 316. In the first three wells 302, 304 and 306, horizontal sections are drilled spaced apart, but at about the same depth within the same zone. In the second three wells 312, 314, and 316 horizontal sections are also drilled spaced apart, but at about the same depth within the same zone. However, the first three wells 302, 304, and 306 can be drilled in an adjoining zone from the zone in which the second three wells 312, 314, and 316 are drilled, or can be drilled within the same zone, but at a different depth. While FIG. 3 illustrates that the lateral wells from each pad are offset from the lateral wells of the opposite pad, it is understood that the lateral wells could be drilled directly over or under the lateral wells of the opposite well. In embodiments, two adjoining wells that are positioned heel to toe to each other have lateral wells that are within at least 1200 ft. from each other, or within 660-1200 ft of each other.

Figure 4:
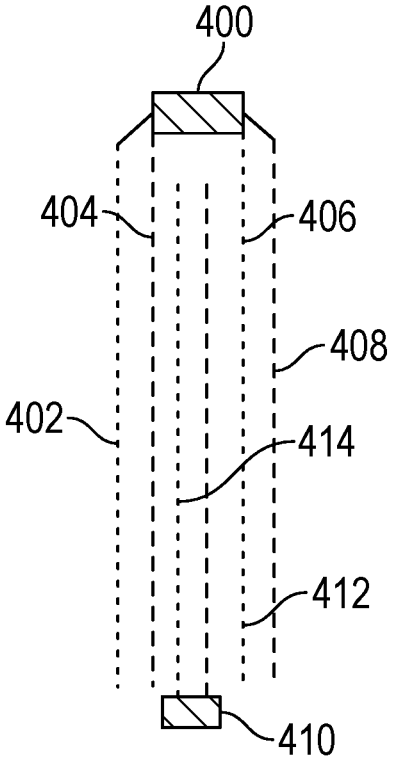
FIG. 4 is an overhead illustration of wells drilled heel to toe between two pads with the first and second pads having wells drilled within two different zones.

FIG. 4 is an overhead view illustrating a first pad 400 comprising four lateral wells: a first well 402, a second well 404, a third well 406, and a fourth well 408; and, a second pad 410 comprising two lateral wells: a fifth well 412 and a sixth well 414. In this example, lateral wells from opposing pads are spaced apart both vertically and laterally. Wells 402, 406, and 414 are located in a first zone, while wells 404, 412, and 408 are located in a second zone. In embodiments, two adjoining wells that are positioned heel to toe to each other have lateral wells that are within at least 1200 ft. from each other at their closest points, or within 660-1200 ft of each other at their closest points.

Figure 5:
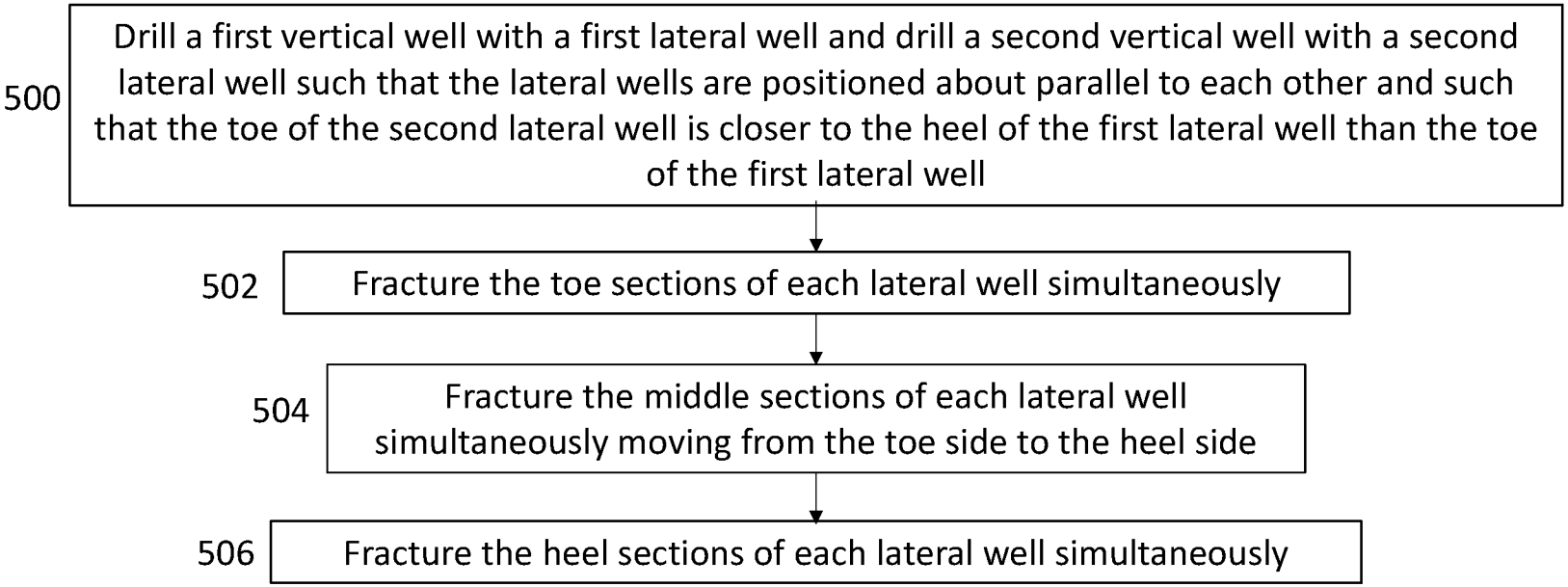
FIG. 5 is a flowchart illustrating a method of fracturing wells that have been drilled heel to toe.

FIG. 5 illustrates an example method of fracturing from the toe to the heel of drilled wells, such as the examples illustrated in FIGS. 1-4. In step 500, a first vertical well with a first lateral well is drilled and a second vertical well with a second lateral well is drilled such that the lateral wells are positioned about parallel to each other and such that the toe of the second lateral well is closer to the heel of the first lateral well than the toe of the first lateral well. In step 502, as a first fracturing step, the toe sections of each lateral well are fractured simultaneously. In step 504, as a second fracturing step, the middle sections of each lateral well are fractured simultaneously moving from the toe end toward the heel end. In step 506, as a third fracturing step, the heel sections of each lateral well are fractured simultaneously.

Figure 6C:
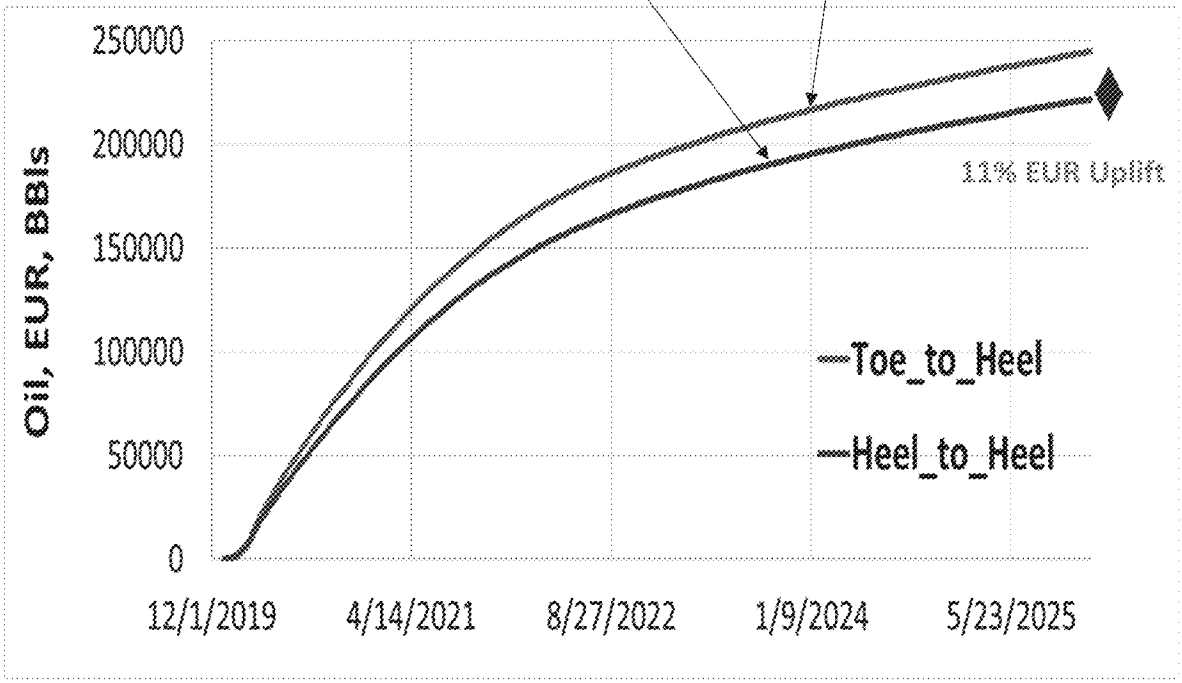
FIG. 6*c* is a graph showing a simulation of recovery for the wells drilled in FIGS. 6*a* and 6*b*.
Figure 6A:
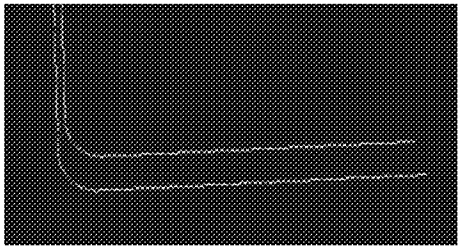
FIG. 6*a* is an illustration of two wells drilled heel to heel.
Figure 6B:
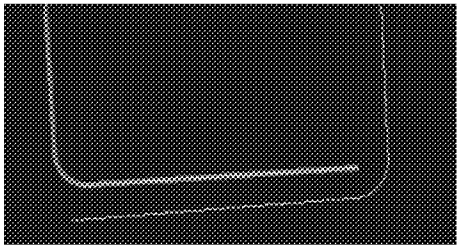
FIG. 6*b* is an illustration of two wells drilled heel to toe.

FIGS. 6*a*, 6*b* and 6*c* illustrate a hydraulic fracturing simulation and the results of the simulation. FIG. 6*a* illustrates a heel to heel well design in which production was calculated from a hydraulic fracturing simulation. The heel to heel approach of FIG. 6*a* differs from the embodiments of FIGS. 1-4 in that the heel of the first lateral well is closer to the heel of the second lateral well than the toe of the second lateral well. FIG. 6*b* illustrates a heel to toe design similar to FIGS. 1-4 in which production was calculated from a hydraulic fracturing simulation. FIG. 6*c* shows the results of the calculated production for the heel to toe design 602 and the heel to heel 600 design. The heel to toe design resulted in an 11% increase in the estimated ultimate recovery from the heel to toe design over the heel to heel design. This increased production can be achieved with any of the scenarios previously described.

Drilling wells heel to toe can improve fracture cluster efficiency. In other words, it leads to a larger fracture area and more recovery. Reducing the stress shadow on toe clusters from the offset well results in more fracture surface area, thereby improving fracture cluster efficiency. As one example, if the well length is two miles, each well will have one mile of its lateral portion to be fractured without the effect of a stress shadow from the offset well.

The heel to toe design also increases the entire pad stimulated reservoir volume. If the toe stages are less stimulated compared to the heel stages because of the pressure friction loss along the lateral portion of the well, heel to toe drilling allows the heel of the first well to stimulate the toe of the other well. Better fracture coverage is achieved by reduction of stress shadowing. The heel to toe design also increases the production contribution of the toe stages, thereby accelerating and improving recovery of hydrocarbon fluids.

Heel to toe design also allows for better coverage of the produced area. The pressure drop along the lateral well is not constant and results in low production from the toe stages when wells are drilled heel to heel. In contrast, with the heel to toe design, the toe stages of one well are more productive due to the fracturing at the proximate heel stage of the parallel well.

Although embodiments described herein are made with reference to example embodiments, it should be appreciated by those skilled in the art that various modifications are well within the scope of this disclosure. Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

What is claimed is:

1. A method for drilling at least two multilateral wells in an unconventional formation, the method comprising:

drilling a first lateral well extending from a first vertical well;

drilling a second lateral well extending from a second vertical well, wherein the first and second lateral wells are positioned about parallel to each other and such that a toe of the second lateral well is closer to a heel of the first lateral well than a toe of the first lateral well;

fracturing the toe of the first lateral well and fracturing the toe of the second lateral well;

fracturing a middle section of the first lateral well and fracturing of a middle section of the second lateral well;

fracturing the heel of the first lateral well and fracturing a heel of the second lateral well;

producing fluid from the first vertical well; and producing fluid from the second vertical well.

2. The method of claim 1, wherein the first lateral well and the second lateral well are less than 1200 feet apart.

3. The method of claim 1, wherein the first lateral well and the second lateral well are in different, but adjacent zones.

4. The method of claim 1, wherein the first lateral well and the second lateral well are in a same zone.

5. The method of claim 1, further comprising drilling a third lateral well from the first vertical well and drilling a fourth lateral well from the second vertical well, wherein the third lateral well comprises a toe, a middle section, and a heel and wherein the fourth lateral well comprises a toe, a middle section, and a heel.

6. The method of claim 5, wherein the third lateral well and the fourth lateral well are positioned about parallel to each other such that the toe of the fourth lateral well is closer to the heel of the third lateral well than the toe of the third lateral well.

7. The method of claim 5, wherein the third lateral well and the fourth lateral well are in a different zone than the first lateral well and the second lateral well.

8. The method of claim 5, wherein the third lateral well is in a same zone as the fourth lateral well.

9. The method of claim 5, wherein the third lateral well is in a different but adjacent zone to the fourth lateral well.

10. The method of claim 5, wherein the third lateral well and the fourth lateral well are less than 1200 feet apart.

11. The method of claim 5, further comprising:

fracturing the toe of the third lateral well and fracturing the toe of the fourth lateral well simultaneously;

fracturing the middle section of the third lateral well and fracturing the middle section of the fourth lateral well simultaneously;

fracturing the heel of the third lateral well and fracturing the heel of the fourth lateral well simultaneously;

producing fluid from the third lateral well; and producing fluid from the fourth lateral well.

12. The method of claim 5, wherein the toes of the first, second, third, and fourth lateral wells are fractured simultaneously, wherein the middle sections of the first, second, third, and fourth lateral wells are fractured simultaneously, and wherein the heel of the first, second, third, and fourth lateral wells are fractured simultaneously.

13. The method of claim 1, wherein the first vertical well and the second vertical well are in different pads.

14. The method of claim 1, wherein fracturing of the toe of the first lateral well and the toe of the second lateral well are performed simultaneously.

15. The method of claim 1, wherein fracturing of the middle section of the first lateral well and fracturing the middle section of the second lateral well are performed simultaneously.

16. The method of claim 1, wherein fracturing the heel of the first lateral well and the heel of the second lateral well are performed simultaneously.

17. The method of claim 1, wherein fracturing the toe of the first lateral well and fracturing the toe of the second lateral well is performed and completed before fracturing the middle section of the first lateral well and fracturing of the middle section of the second lateral well and wherein fracturing the middle section of the first lateral well and fracturing of the middle section of the second lateral well is completed before fracturing the heel of the first lateral well and fracturing the heel of the second lateral well.

18. A well system comprising:

a first lateral well extending from a first vertical well, the first lateral well comprising a toe, a middle section, and a heel; and a second lateral well extending from a second vertical well, the second lateral well comprising a toe, a middle section, and a heel, wherein the first lateral well and the second lateral well are about parallel to each other and wherein the toe of the second lateral well is closer to the heel of the first lateral well than the toe of the first lateral well, and wherein the toes of the first lateral well and the second lateral well have been fractured in a first fracturing step, the middle sections of the first lateral well and the second lateral well have been fractured in a second fracturing step, and the heels of the first lateral well and the second lateral well have been fractured in a third fracturing step.

19. The well system of claim 18, wherein the first lateral well and the second lateral well are within 1200 feet of each other at their closest points.

20. The well system of claim 18, wherein the toe of the first lateral well produces hydrocarbons via the heel of the second lateral well.

* * * * *